United States Patent [19]

Linden

[11] 4,258,592

[45] Mar. 31, 1981

[54] DEVICE FOR SHARPENING OF SCISSORS

[75] Inventor: Erkki O. Lindén, Billnäs, Finland

[73] Assignee: OY. Fiskars AB, Helsinki, Finland

[21] Appl. No.: 42,483

[22] Filed: May 25, 1979

[30] Foreign Application Priority Data

Jun. 6, 1978 [FI] Finland ..... 781801

[51] Int. Cl.[3] ..... B21K 11/06

[52] U.S. Cl. ..... 76/82.2

[58] Field of Search ..... 76/82, 86, 82.2; 51/204, 205 WG, 214, 286, 211; D8/93

[56] References Cited

U.S. PATENT DOCUMENTS

| | | | |
|---|---|---|---|
| 435,697 | 9/1890 | Johnson | 76/86 |
| 1,051,333 | 1/1913 | Jacoby | 76/82.2 |
| 2,468,442 | 4/1949 | Heard | 76/82.2 |
| 2,765,680 | 10/1956 | Murchison | 76/86 |

*Primary Examiner*—Othell M. Simpson
*Assistant Examiner*—Roscoe V. Parker
*Attorney, Agent, or Firm*—Ladas & Parry

[57] ABSTRACT

Device for sharpening of scissors, consisting of a disk-shaped body (1) provided with two lengthy openings (2,3) for the scissor blades (8). The openings are on one long side and on one short side limited by sharpening means (4,5) consisting of round pins. The openings (2,3) are positioned so in relation to each other that the active faces of the sharpening means (4) on the long sides, which act upon the inside of the cutting edges, are in line with each other.

4 Claims, 5 Drawing Figures

DEVICE FOR SHARPENING OF SCISSORS

Figure 1:
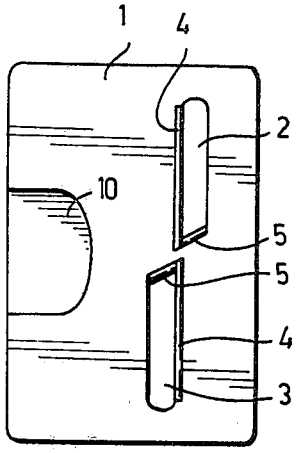

The present invention relates to a device for sharpening of scissors, said device consisting of a body and of sharpening means in the shape of substantially round pins with smooth surface fastened onto the body at a certain angle in relation to each other and arranged so as to be slidingly moved along the inside and outside of the cutting edge of a scissors' blade.

Simultaneous sharpening of both sides of the cutting edge is previously known in connection with devices for manual sharpening of knives, see, e.g., U.S. Pat. No. 2,765,680 and West-German Pat. No. 1,577,605.

As regards scissors, it is a previously known procedure to sharpen scissors that have become dull after some time of use by means of grinding disk, file, whetsone, etc. In the first-mentioned case it is required that the grinding equipment is available, and in any case a skill is required that is usually not possessed by people not skilled in the art, whereby a sharpening performed at home normally gives an unsatisfactory result. As a rule, in this connection, only the edge is ground. Sometimes it is, however, necessary, in order to remove burr or to correct the shape of the edge, to process both the sides adjoining the edge. In such cases, two-sided processing is required, which, of course, according to the known methods, involves two separate working steps.

A device for cutting processing of the inside of the cutting edge is described in the U.S. Pat. No. 2,468,442. The device comprises a handle and two metal disks whose flat sides are lying against each other and whose opposite edges are provided with shears that process both blades of the scissors at the same time. During sharpening, the inside of the blade is supported against the flat side of one of the disks. This device does not give a satisfactory result, e.g., because of the slit that always exists between the disks, and owing to the one-sided processing it is impossible to act upon the shape of the edge and upon the burr during the sharpening.

A device for simultaneous sharpening of both scissor blades by means of a round pin with smooth surface is described in the German Pat. No. 695,188. The device consists of a body in the shape of a disk and of a round pin that is fastened to one edge of the body and is positioned in the plane of the body. The pin forms an angle of about 60° in relation to the edge of the body. The sharpening is performed so that a cutting movement is performed with the scissors with the pin placed between the scissors' blades, whereby the pin processes the outer sides of the cutting edges while the scissors' blades are lying against the body edge.

Thus, this device also processes only the outer sides of the cutting edges, whereby no final shaping of the edge and of the burr can be obtained. Moreover, the guiding of the scissors' blades is highly imperfect, whereby the scissors' blades tend to assume a position perpendicular to the pin, which destroys the blades.

The object of the present invention is to provide a sharpening device for scissors in which a desired shaping of both scissors' blades is obtained in one working step and the sharpening means are during the entire sharpening process in the correct position in relation to the side faces of the scissors' blades, whereby a person not skilled in the art can also sharpen scissors with an optimum result. This object is achieved thereby that the device comprises two pairs of sharpening means positioned at an angle, one pair for each scissors' blade, and that the active faces of the sharpening means that process the inside of the cutting edges are placed substantially in line with each other. Hereby, each scissors' blade is, during sharpening, lying against two sharpening means placed at an angle, and when a cutting movement is performed with the scissors during sharpening, each scissors' blade is pressed down into the wedge-shaped opening between the sharpening means of the device for the outside and the inside of the blade, and the scissors' blades are thereby held steadily in the correct position.

According to a preferred embodiment, the angle between the sharpening means is somewhat larger than the angle between the inside and the outside of the cutting edge. Hereby an appropriate shaping of the burr formed on the cutting edge during the use of the blade is obtained, whereby the cutting edge obtains optimum sharpness.

Another preferred embodiment of the invention is characterized in that both pairs of sharpening means placed at an angle are positioned on a long side and on a short side, respectively, of a through opening in the body. This construction gives the possibility of guiding the blade from three or four sides, and at the same time it makes the device highly reliable, because the scissors' blades cannot slip to the side away from the wedge-shaped opening owing to careless handling of the device. It is also advantageous that the pins in each pair of sharpening means are shifted in relation to each other in the direction of sharpening. Hereby the produced burr can be deformed in the desired direction by means of the pin that acts upon the cutting edge later and, as the pins can be made to cross each other, no discontinuity arises between the sharpening means.

Figure 2:
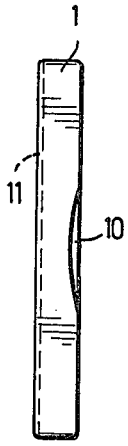
Figure 4:
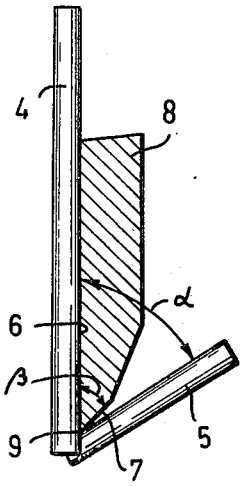
Figure 3:
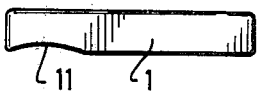
Figure 5:
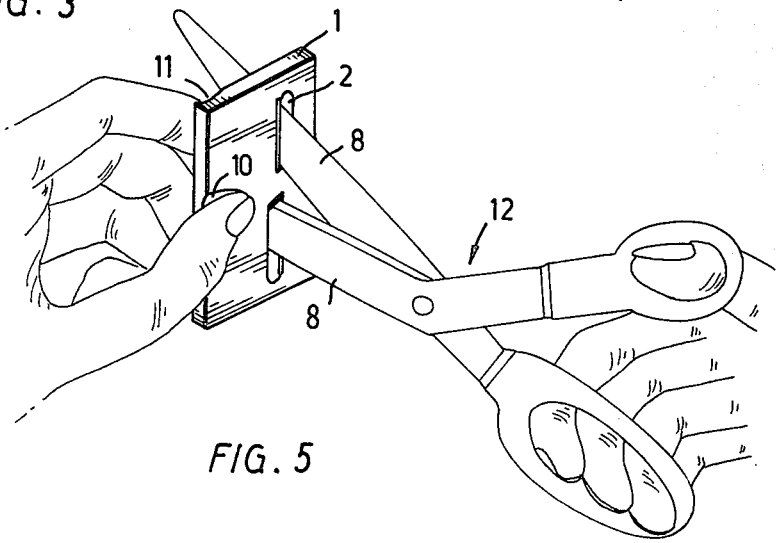

A preferred embodiment of the device in accordance with the invention will be described more closely below with reference to the attached drawing, wherein FIG. 1 shows the device in accordance with the invention as a plane view, FIG. 2 shows the device as a side view, FIG. 3 shows the device as an end view, FIG. 4 shows two sharpening means and one blade as enlarged, and FIG. 5 illustrates the process of sharpening.

The device in accordance with the invention substantially comprises a body 1 in the shape of a rectangular disk, e.g., wood or plastics. The body has two substantially rectangular through openings 2 and 3, on one of whose long sides and one of whose short sides sharpening means of the shape of round pins 4 and 5 with smooth surfaces are fixed. The long sharpening pins 4 are arranged so that those of their sides that are facing the opening are placed along the same line or in the same plane. The sharpening pins 4 and 5 form an acute angle $\alpha$ with each other, which angle substantially corresponds the angle $\beta$ between the inside 6 and outside 7 of the cutting edge 9 of the blade 8. In view of the result, it has, however, proved particularly favourable to make the angle $\alpha$ slightly larger than the angle $\beta$, as is shown in FIG. 4. As is shown additionally in FIG. 4, the pin 5 is placed behind the pin 4.

It should be pointed out in this connection that corresponding devices for sharpening of knives which process both sides of the knife blade are not usable for scissors, for which it is essential that the sharpening means for the main planes of the scissors' blades are placed, as was mentioned above, in the same plane.

Only in this way is it possible to obtain a reliable cutting effect.

The side faces of the body 1 are provided with guides 10 and 11 for a suitable grasp during sharpening. The guide 10 consists of a recess opening towards one of the long sides, whereas the guide 11 consists of a shallow groove parallel with said long side.

FIG. 5 illustrates the sharpening process itself. The body 1 is grasped with the left hand so that the thumb presses against the guide 10 and the other fingers against the guide 11. Hereupon the blades 8 of scissors 12 are passed through the openings 2,3 in the body as far as possible, whereupon a cutting movement is performed, i.e. the scissor loops are moved towards each other, whereby the body 1 slides towards the left in FIG. 5 until the tips of the blades have left the openings. During this relative sliding movement between the body 1 and the scissors 12 the blades 8 are pressed in between the sharpening pins 4 and 5, and the inside 6 and the outside 7 of the cutting edges 9 are deformed against the pins. This procedure is repeated a few times in order to obtain a satisfactory result.

As is evident from the above, the side faces of the cutting edges are not ground or filed during sharpening, but the sharpening is performed mainly by means of deformation of the burr formed on the cutting edge during use. Owing to the relative angle position of the sharpening pins 4, 5 and owing to their being displaced in the sharpening direction in relation to each other, the pin 5 first deforms the burr so that the burr is projected diagonally upwards to the left in FIG. 4. Owing to the deforming effect of the sharpening pin 4, the burr is thereafter directed straight down, parallel with the pin 4, which gives the blade optimum sharpness.

It should be noticed that the angle between the sharpening means may be adjustable, e.g., by providing the device with several grooves with different angular positions for the sharpening means.

What we claim is:

1. A device for sharpening of scissors, said device consisting of a body (1) and of sharpening means (4,5) in the shape of substantially round pins with smooth surface fastened onto the body at a certain angle ($\alpha$) in relation to each other and arranged so as to be slidingly moved along the inside (6) and outside (7) of the cutting edge (9) of a scissors' blade (8), characterized in that the device comprises two pairs of sharpening means (4,5) positioned at an angle, one pair for each scissors' blade (8), and that the active faces of the sharpening means (4) that process the inside (6) of the cutting edges (9) are placed substantially in line with each other.

2. A device as claimed in claim 1, characterized in that the angle ($\alpha$) between the sharpening means (4,5) is somewhat larger than the angle ($\beta$) between the inside (6) and the outside (7) of the cuting edge.

3. A device as claimed in claim 1 or 2, characterized in that each pair of sharpening means (4,5) placed at an angle is placed on a long side and on a short side, respectively, of a through opening (2,3) in the body.

4. A device as claimed in claim 1, characterized in that the pins (4,5) in each pair of sharpening means are displaced in relation to each other in the sharpening direction.

* * * * *